US007448352B2

(12) United States Patent
Warren

(10) Patent No.: US 7,448,352 B2
(45) Date of Patent: Nov. 11, 2008

(54) CENTRALLY LOCATED IGNITION SOURCE IN A COMBUSTION CHAMBER

(76) Inventor: James C. Warren, 5409 Galley Ct., Fairfax, VA (US) 22032

( * ) Notice: Subject to any disclaimer, the term of this patent is extended or adjusted under 35 U.S.C. 154(b) by 0 days.

(21) Appl. No.: 11/589,118

(22) Filed: Oct. 30, 2006

(65) Prior Publication Data

US 2007/0095320 A1 May 3, 2007

Related U.S. Application Data

(60) Provisional application No. 60/731,266, filed on Oct. 31, 2005.

(51) Int. Cl.
*F02P 15/00* (2006.01)
*F02B 57/00* (2006.01)

(52) U.S. Cl. ..... 123/161; 123/51 R; 123/43 R; 123/143 R

(58) Field of Classification Search ..... 123/46 R, 123/143 R, 153, 161, 43 R, 51 R
See application file for complete search history.

(56) References Cited

U.S. PATENT DOCUMENTS 2,298,219 A 10/1942 Major
4,272,237 A * 6/1981 Smith ..... 431/328
4,300,512 A * 11/1981 Franz ..... 123/536
4,848,287 A 7/1989 Gillbrand et al.
5,042,441 A 8/1991 Paul et al.
5,058,536 A 10/1991 Johnston
5,590,629 A 1/1997 Codina et al.
6,443,728 B1 * 9/2002 Edberg et al. ..... 431/266
7,004,120 B2 * 2/2006 Warren ..... 123/43 R
2004/0221823 A1 11/2004 Warren

FOREIGN PATENT DOCUMENTS

JP 01-150709 6/1989
JP 2005-129396 5/2005

* cited by examiner

*Primary Examiner*—Stephen K. Cronin
*Assistant Examiner*—J. Page Hufty

(57) ABSTRACT

The centrally located ignition source in a combustion chamber is an electrical conductor spanning the general center of the combustion chamber, with a spark gap at the general center of the conductor. The device may be offset from the combustion chamber centerline, and/or the spark gap may be offset from the conductor center, as required. The centrally located ignition source is particularly well suited for use in an opposed piston engine having a rotary sleeve valve mechanism, with the conductor rotating with the sleeve valve and crossing the combustion chamber between the two pistons. An arcuate commutator section may be disposed upon the exterior of the rotary sleeve valve, with a contact finger making electrical contact between the electrical energy source and the commutator section to supply electrical energy to the ignition source. The device is also suitable for use in stationary installations, e.g., gas furnace combustors, etc.

17 Claims, 3 Drawing Sheets

CENTRALLY LOCATED IGNITION SOURCE IN A COMBUSTION CHAMBER

CROSS-REFERENCE TO RELATED APPLICATION

This application claims the benefit of U.S. Provisional Patent Application Ser. No. 60/731,266, filed Oct. 31, 2005.

BACKGROUND OF THE INVENTION

1. Field of the Invention

The present invention relates generally to spark ignition systems for use in combustion devices, e.g., reciprocating engines, furnaces, etc. More specifically, the present invention comprises various embodiments of an ignition device that spans a combustion chamber volume, with the ignition spark occurring in the general center of the combustion chamber volume.

2. Description of the Related Art

Electrical or spark ignition systems for various types of combustion devices are extremely well known. Such spark ignition systems are commonly used to ignite the fuel/air mixture in reciprocating engines, as well as other types of engines. Such spark ignition systems are also used in heater combustors, furnaces, and various other devices that burn fuel to produce heat.

The ignitors (e.g., spark plugs) used in such devices are nearly universally located in the wall of the combustion chamber, where wiring and access to the ignitor is facilitated. However, this generally results in less than optimum ignition and burning of the air/fuel mixture within the combustion chamber, due to the peripheral location of the ignition source in comparison to the central volume of the combustion chamber. The peripheral location of the ignition source generally necessitates a richer fuel mixture due to the displaced position of the ignition source from its optimal center position, as well as resulting in increases in emissions and less than optimum efficiency, i.e., poorer fuel mileage than the ideal in a motor vehicle.

The need for a centralized location for the ignition source is especially critical in certain types of reciprocating engines. An example of such is found in U.S. Patent Publication No. 2004/221,823 published on Nov. 11, 2004 to the present inventor, titled "Opposed Piston Engine," now issued as U.S. Pat. No. 7,004,120 on Feb. 28, 2006, the disclosure of which is hereby incorporated by reference in its entirety. This engine is structured with a single common combustion chamber for each pair of opposed pistons, with the opposed pistons driving a pair of opposed crankshafts at the outer sides of the engine. An ignition source spans the center of each combustion chamber, with the spark traveling between the ignition source and a protuberance extending from the center of the piston. In contrast, the present ignition system does not rely upon another moving component to provide a continuation of the electrical path, but rather uses a conductor spanning the combustion chamber and having a spark gap therein to produce the generally centrally located ignition spark.

The present inventor is also aware of other spark ignition devices that serve to ignite a fuel/air mixture within a combustion chamber. Japanese Patent No. 1-150,709, published on Jun. 13, 1989, describes (according to the drawings and English abstract) a burner having an axial ignition conductor extending therethrough to a ground ring surrounding the end of the conductor. The ground ring is located in a foraminous ceramic diffuser. A spark jumping the gap between the tip of the conductor and the ground ring ignites the gas mixture flowing through the ceramic diffuser. The device does not span the general center of the combustion chamber, but rather is located in one wall of the combustion chamber as defined by the ceramic diffuser.

Finally, Japanese Patent No. 2005-129,396, published on May 19, 2005, describes (according to the drawings and English abstract) a gas burner having an electrical ignitor therein. The ignitor is shown to be offset from the center of the device in the detail view of FIG. 5 of this reference, and does not span the diameter of the combustion chamber.

Thus, a centrally located ignition source in a combustion chamber solving the aforementioned problems is desired.

SUMMARY OF THE INVENTION

The centrally located ignition source in a combustion chamber provides a generally centralized ignition spark for the fuel/air mixture in the combustion chamber of an internal combustion engine, as opposed to the nearly universally peripherally located ignition source of most combustion chambers found in engines, furnace combustors, etc. The present centrally located ignition source is particularly well suited for use with the opposed piston engine developed by the present inventor, which includes a rotary sleeve surrounding each opposed piston pair to provide the valve mechanism for the engine. The present ignition source extends generally diametrically across the rotary sleeve, with an arcuate external contact on the sleeve providing an electrically conductive path from the energy source for the ignition to the rotating conductor and spark gap within the combustion chamber.

The ignition source is preferably located across the general center of the combustion chamber, with the spark gap being located at the general center of the spark rod conductor spanning the combustion chamber. However, the spark rod may be offset somewhat from the center of the combustion chamber, if so desired, and/or the spark gap may be offset from the center of the spark rod, if it is deemed to be more desirable to place the spark at some location other than the geometric center of the combustion chamber.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an ignition source that provides a generally centrally located ignition point within a combustion chamber. The combustion chamber may be any practicable volume as used in furnaces, internal combustion engines, etc., but the present invention is particularly directed to incorporation with an opposed piston engine, i.e., an engine having a central combustion chamber located between each opposed piston pair, with each piston driving an outboard crankshaft. The present ignition source is adapted for inclusion in such an engine where the engine incorporates a rotary sleeve valve, which defines the generally cylindrical wall of the combustion chamber, with the ignition source rotating with the sleeve valve during engine operation.

Figure 1:
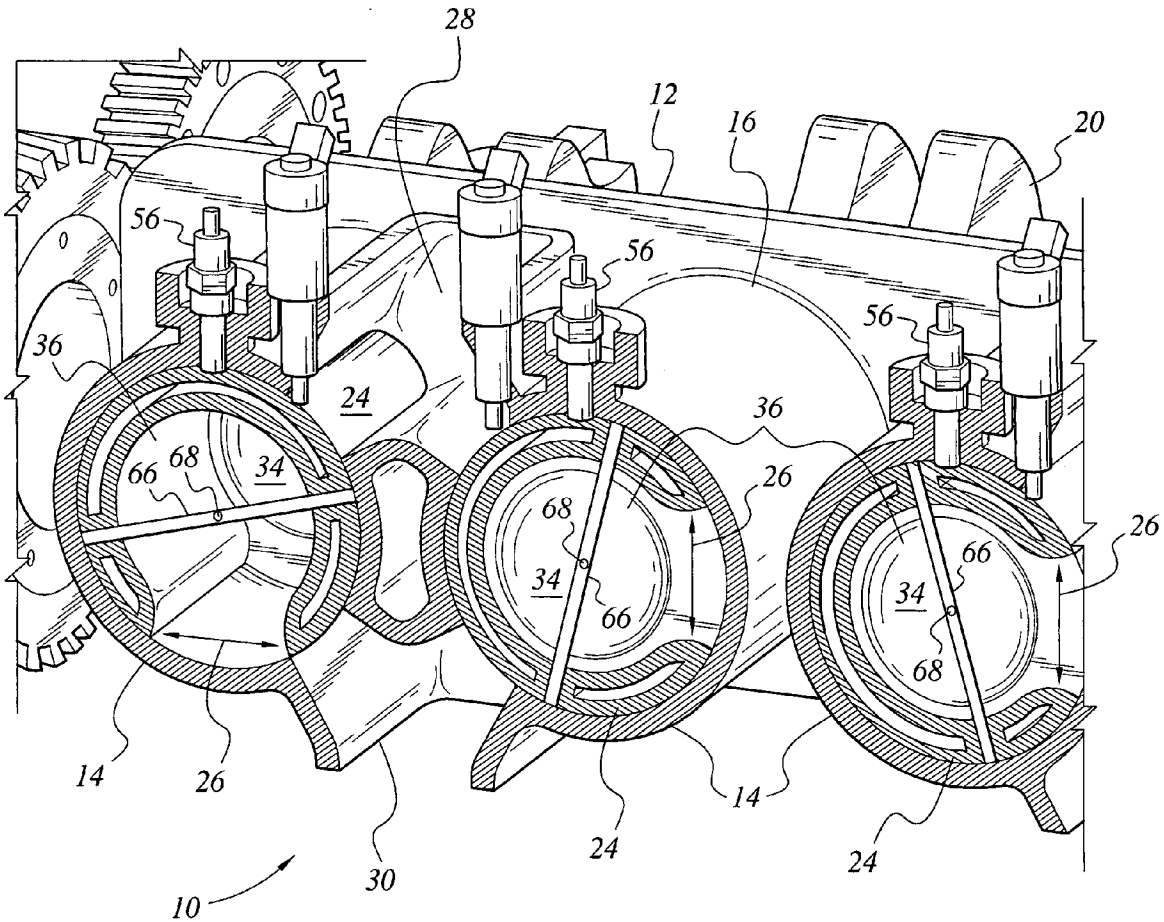
FIG. 1 is a perspective view of an opposed piston engine incorporating the centrally located ignition source of the present invention in section through the midline of the combustion chambers to show the positioning of the ignition source.
Figure 3:
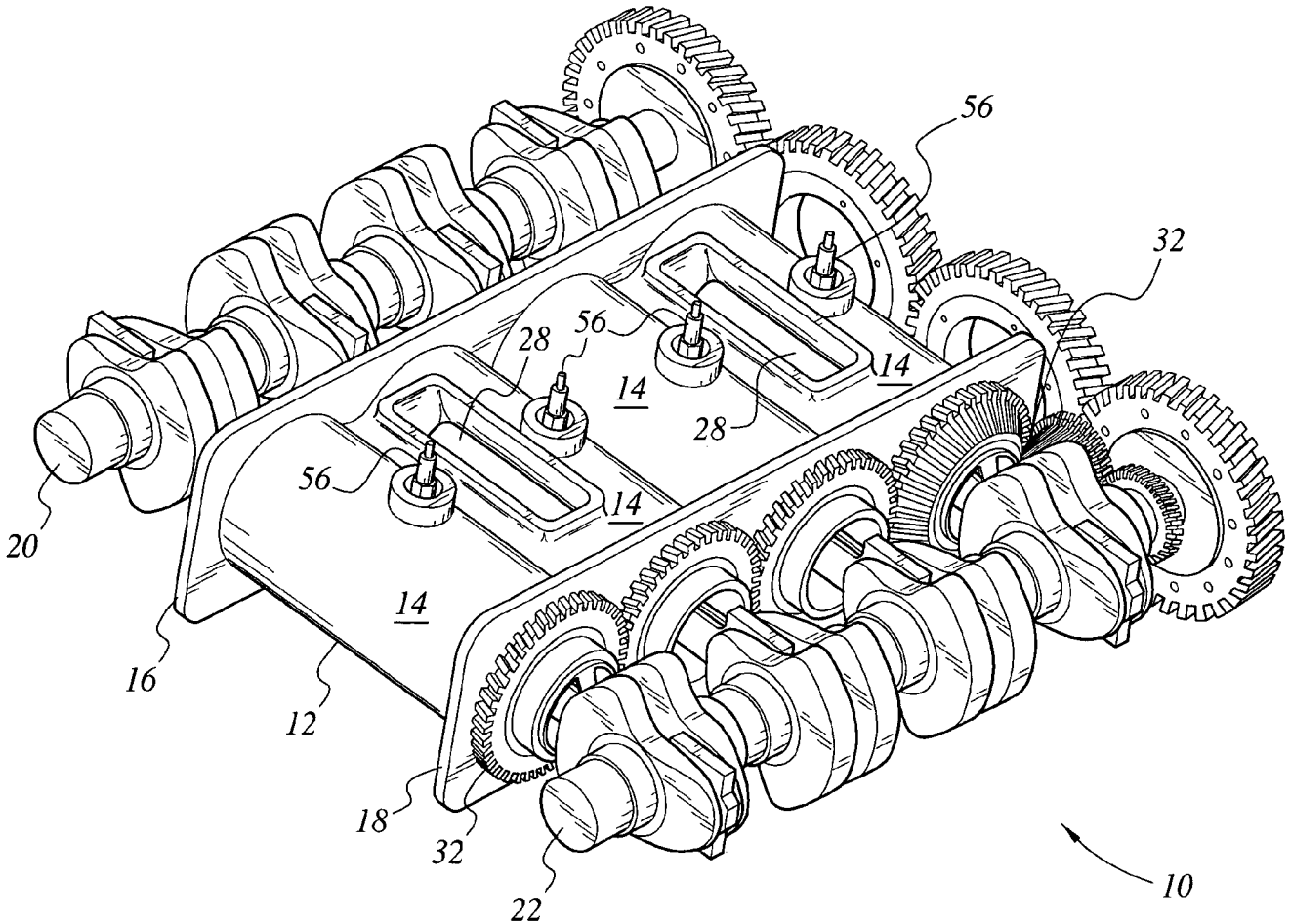
FIG. 3 is an external perspective view of the opposed piston engine of FIG. 1 showing further details thereof, including the external ignition components of the ignition source of the present invention.

FIG. 1 of the drawings provides a section view through the center of an opposed piston engine 10, the view being drawn through the center of the combustion chambers of the engine. The complete engine 10 (less enclosures for the crankshafts and gearing, and other external components) is illustrated in FIG. 3 of the drawings. The opposed piston engine 10 includes a cylinder block 12 having a series of individual cylinder bores 14. The block 12 and cylinders 14 may be formed conventionally, e.g., cast as a single, monolithic unit, or manufactured as separate components and mechanically assembled together, as desired. The width of the block 12 defines the opposed first and second ends, respectively 16 and 18, of each cylinder 14, with respective first and second crankshafts 20 and 22 residing just outboard of the respective cylinder ends 16 and 18 and communicating mechanically with the opposed pistons in each cylinder 14 by means of conventional connecting rods.

Each cylinder 14 further includes a rotating sleeve valve or cylinder liner 24 therein, with the sleeve valve 24 having an open side or port 26, which aligns periodically with the intake and exhaust ports 28 and 30 through the side of the cylinder 14. The sleeve valves 24 are rotated by a gear train 32 (FIG. 3), which is, in turn, driven by the rotation of one of the two crankshafts, e.g., the second crankshaft 22. Opposed first and second pistons (not shown in the present disclosure, but illustrated and described in U.S. Pat. No. 7,004,120, issued Feb. 28, 2006 to the present inventor, which is hereby incorporated herein by reference) reciprocate within the rotating sleeve valves 24. The valves 24, in turn, rotate within the relatively stationary cylinder bores 14. Each piston includes a non-circular rotating crown 34, configured to fit closely within the sleeve valve 24 to close off the sleeve valve intake and exhaust port 26 between the combustion chamber 36 and the crankshafts 20 and 22. The piston crowns 34 rotate with the rotary sleeve valves 24 to maintain a good seal between the crowns 34 and the sleeve valves 24 as they rotate, while allowing the pistons to maintain their non-rotating relationship with the conventional wrist pins and connecting rods, which link them to their respective crankshafts 20 and 22. The pistons, or more precisely their rotating crowns 34, along with the walls of the sleeve valves 24, define the combustion chambers 34 of the engine 10. The combustion chambers 36 are laterally symmetrical, due to the identical configurations of the pistons and their crowns 34 and the mirror image reciprocation of each piston pair during engine operation.

Figure 2:
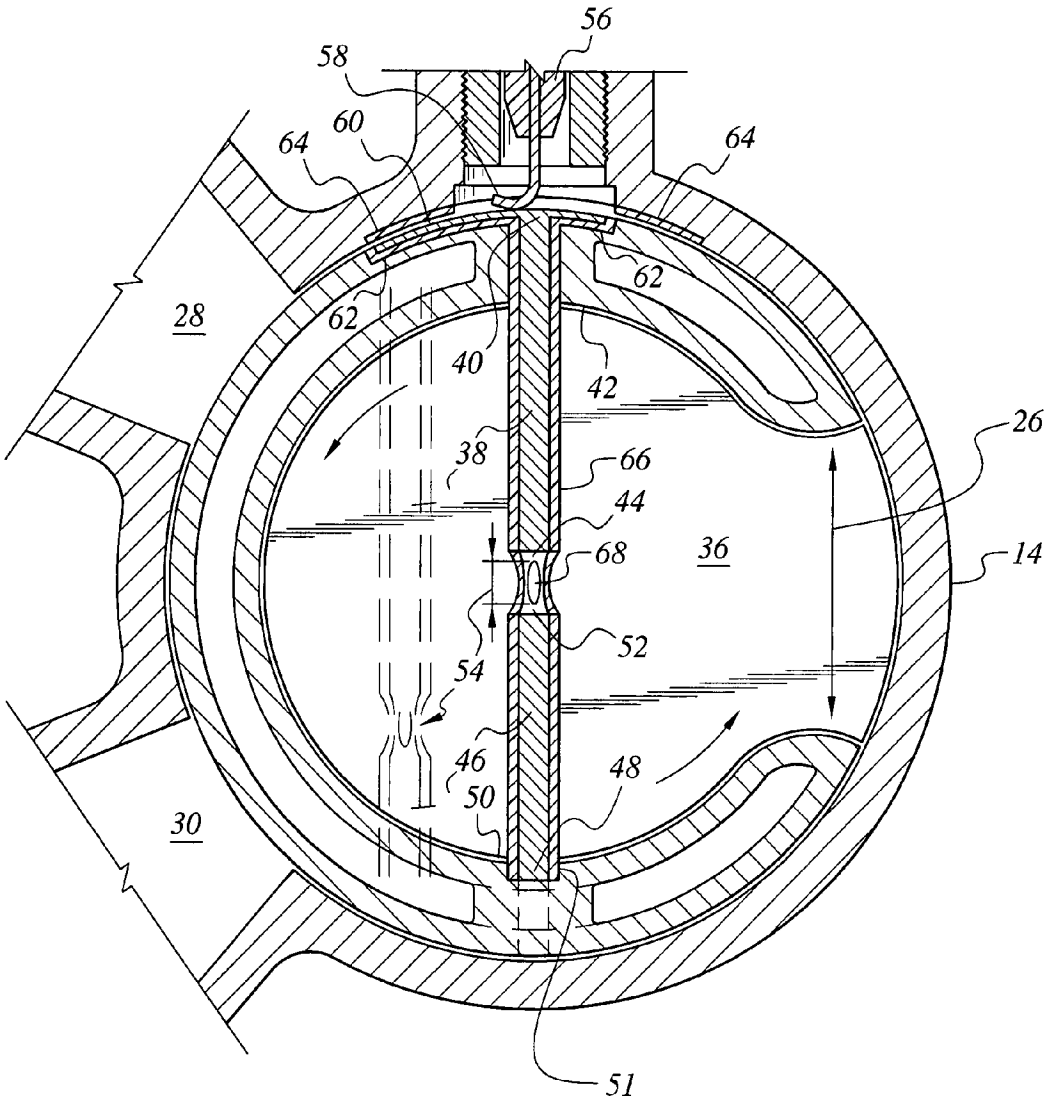
FIG. 2 is a detailed elevation view in section through one cylinder of the opposed piston engine of FIG. 1, showing further details of the ignition source according to the present invention.

FIG. 1 of the drawings illustrates the general configuration and installation of the centrally located ignition source across the combustion chambers 36 of the engine 10, while FIG. 2 provides a more detailed view of a single such ignition source installation. The centrally located ignition source within each combustion chamber 36 comprises a two-piece spark rod, which crosses generally diametrically through the general center of the combustion chamber 36. The spark rod, in turn, comprises an elongate electrical delivery conductor 38 having a base end 40 that is mechanically secured to a first side 42 of the sleeve valve wall 24. The conductor 38 extends inwardly within the interior of the sleeve valve 24 toward the general center of the combustion chamber 36, and terminates in an opposite electrode end 44 disposed in the general center of the combustion chamber 36. While the conductor 38 is mechanically attached to the sleeve valve wall 24, it is electrically insulated therefrom. As the conductor 38 is mechanically affixed to the sleeve valve wall 24, it will be seen that the conductor 38 rotates in unison with the rotation of the sleeve valve 24 during engine operation.

A second spark rod component comprises an elongate electrical ground conductor 46 having an electrically grounded end 48 which is mechanically and electrically connected to the second side 50 of the sleeve valve wall 24 opposite the first side 42 of the sleeve valve wall 24. The ground conductor 46 further includes an opposite electrode end 52 disposed in the general center of the combustion chamber 36 adjacent the electrode end 44 of the delivery conductor 38. The two electrode ends 44 and 52 of the two conductors 38 and 46 define an ignition spark gap 54 therebetween, with a spark jumping the gap 54 when sufficient electrical potential is applied to the delivery conductor 38. As in the case of the delivery conductor 38, the ground conductor 46 rotates in unison with the rotation of the sleeve valve 24. The dimension of the spark gap 54 may be adjusted by providing a threaded base end for one of the two conductors, e.g., the ground conductor 46, passing the base end 48 into a passage or recess 51 of the rotary valve side wall 24 (as shown in broken lines in FIG. 2), and threading it inwardly or outwardly in its attachment to the rotary valve side wall 24.

FIG. 2 also illustrates various alternative embodiments of the present ignition source. The embodiment shown in solid lines in FIG. 2 extends substantially diametrically across the sleeve valve 24 and combustion chamber 36, with the spark gap 54 located essentially in the center of the spark rod assembly and combustion chamber 36. This provides theoretically optimum ignition for the fuel/air mixture within the combustion chamber, with the flame propagation spreading essentially equally in all directions from such a centrally located ignition source. However, it may be desired to locate the spark gap somewhat away from the theoretical center of the combustion chamber 36, in some instances. An alternative, asymmetric placement of the spark rod assembly comprising the delivery conductor 38 and ground conductor 46 is shown in broken lines in FIG. 2, offset from the diametric center of the combustion chamber 36.

It will also be noted that the spark gap 54 of the alternative non-diametric spark rod location is not centered along the length rod, i.e., the delivery conductor and ground conductor are different lengths in the alternative broken line showing of the ignition source. Such an alternative, non-centered location for the spark gap may be desirable in certain circumstances, e.g., to adjust for the non-circular shape of the combustion chamber 36 due to the volume of the sleeve valve port 26. However, in all cases the spark gap 54 is located within the generally central area or volume of the combustion chamber 36, as opposed to a precisely located central point. In all cases the spark gap 54 is located well away from the peripheral wall of the combustion chamber 36, as defined by the two opposed piston crowns 34 and the rotating sleeve valve 24, and thus may be considered to be generally centrally located within the combustion chamber 36.

An electrical supply conductor 56 extends through the cylinder block 12 into each cylinder, centrally disposed between the two cylinder ends 16 and 18. The supply conductor 56 may have an external configuration similar to a conventional spark plug, i.e., an externally threaded base that threads into a mating bore in the cylinder block 12 to affix the conductor 56 immovably in the cylinder block 12. A conventional terminal end may be provided for the connection of the external ignition harness thereto. However, rather than having a spark gap as in a conventional spark plug, the electrical supply conductor 56 has an electrically conductive finger or brush 58 extending inwardly therefrom.

The finger or brush 58 makes periodic electrical contact with the base end 40 of the electrical delivery conductor 38 within the rotating sleeve valve 24 as it rotates during engine operation, as the base end 40 of the conductor 38 penetrates through the wall of the sleeve valve 24. It will be noted that this would limit the management of the spark timing at the gap 54, if such a relatively small point contact were provided between the delivery conductor base 40 and the supply conductor finger or brush 58. Accordingly, an electrical commutator segment 60 is placed within the outer wall of the rotary sleeve valve 24, and subtends an arc about the generally cylindrical sleeve valve 24. This assures electrical communication between the supply conductor finger or brush 58 and the base 40 of the delivery conductor 38 through a wide span of rotation of the sleeve valve 24, and thus through a relatively wide range of piston travel near top dead center. Preferably, the commutator segment 60 extends on the order of thirty degrees before top dead center of piston travel, and may extend some few degrees beyond top dead center of piston travel to allow the ignition timing to be set or adjusted either automatically or manually as required for optimum engine operation, depending upon engine load and speed, starting operations, etc.

The commutator segment 60 is disposed with its outer surface contiguous with the curved outer surface of the cylindrical sleeve valve 24 in order to provide a smooth surface for the sleeve valve 24 as it rotates within the cylinder bore 14. As the sleeve valve 24 is preferably formed of an electrically conductive metal, some means of insulating the electrical path from the commutator segment 60 to the delivery conductor 38 is required. Accordingly, an electrically insulating layer 62 is provided between the commutator segment 60 and the underlying and adjacent sleeve valve wall 24. The electrically insulating layer 62 between the commutator segment 60 and the sleeve valve 24 may continue in an electrically insulating unbroken path to surround the electrical delivery conductor 38 and electrical ground conductor 46 (obviously excepting clearance around the spark gap 54). A corresponding electrically insulating layer 64 is provided immediately within the wall of the stationary cylinder 14 adjacent the passage for the electrical supply conductor 56, in order to prevent the passage of the ignition energy directly to ground from the commutator segment 60 to the adjacent cylinder 14 wall.

While electrical insulation along the lengths of the delivery and ground conductors 38 and 46 is not required due to the relatively large span between the generally centrally located spark gap and any other electrically grounding structure, such a continuous insulation tube 66 can provide additional physical or mechanical strengthening for the ignition rod assembly comprising the two conductors 38 and 46. Without such a continuous tube 66 surrounding the two conductors 38 and 46, the conductors 38 and 46 would tend to vibrate and flex due to the extreme gas flow pressures occurring within the combustion chamber 36, and their closely adjacent electrode tips 44 and 52 would move relative to one another and vary the spark gap span 54, thereby affecting ignition efficiency and timing. However, the insulator tube 66 includes at least one spark exposure aperture or passage 68 (and preferably a series of such passages 68) immediately adjacent the spark gap 54, to allow the air/fuel mixture to circulate and flow therethrough in the vicinity of the spark gap 54 in order for an ignition spark to ignite the air/fuel mixture when the spark occurs.

In conclusion, the present centrally located ignition source provides significant improvements in ignition and combustion efficiency over conventional, generally peripherally disposed ignition sources. The placement of the ignition source in the center of the combustion chamber results in a uniform flame propagation from the center of the combustion chamber, thereby producing uniform combustion pressures for smoother operation and avoiding or greatly reducing localized hot spots within the combustion chamber which might lead to pre-ignition or detonation of the air/fuel mixture. This in turn may allow an opposed piston reciprocating engine utilizing the present ignition source or system, to operate on less costly fuels of lower antiknock ratings, thereby providing greater economy of operation. However, it should be noted that although the present disclosure is directed primarily to an ignition source or system for use with such an opposed piston engine, the present centrally located ignition source in a combustion chamber may be applied to other devices than engines, such as furnace combustors and the like. Accordingly, the present centrally located ignition source will find widespread application to numerous combustion devices and systems, and will serve to increase the operating efficiency and economy of such devices in which it is installed.

It is to be understood that the present invention is not limited to the embodiments described above, but encompasses any and all embodiments within the scope of the following claims.

I claim:

1. A centrally located ignition source for initiating combustion, comprising:

an elongated combustion chamber having opposing first and second ends;

an elongate electrical delivery conductor having a base end;

an elongate electrical ground conductor having an electrically grounded end;

an electrical supply conductor disposed externally to the combustion chamber and periodically communicating electrically with the base end of the electrical delivery conductor; and, a wall rotating relative to said electrical supply conductor, said electrical supply conductor having a contact brush extending therefrom, the brush periodically communicating electrically with the base end of said electrical delivery conductor in accordance with rotation of the combustion chamber wall, the base end of the elongate electrical delivery conductor being secured to a first side of the wall, an electrode end thereof being disposed within the combustion chamber opposite the base end, the electrically grounded end of the elongate electrical ground conductor being mechanically and electrically connected to a second side of the wall, and an electrode end of the elongate electrical ground conductor being disposed within the combustion chamber opposite the electrically grounded end thereof, the electrode end of the electrical delivery conductor and the electrode end of the electrical ground conductor defining an ignition spark gap therebetween, the spark gap being disposed centrally between the opposing ends of the combustion chamber, the electrically grounded end being received within a recess formed in the second side of the wall, the electrically grounded end being selectively positionable with respect to the wall to selectively adjust a width of the ignition spark gap.

2. The centrally located ignition source according to claim 1, further including an electrical insulator tube disposed about said electrical delivery conductor and said electrical ground conductor.

3. The centrally located ignition source according to claim 2, wherein said electrical insulator tube has at least one spark exposure aperture disposed adjacent the ignition spark gap.

4. The centrally located ignition source according to claim 1, further including an electrical commutator segment disposed within the combustion chamber wall and subtending an arcuate portion thereof, said electrical supply conductor communicating electrically with said commutator segment through a partial revolution of the combustion chamber wall.

5. The centrally located ignition source according to claim 4, further including an electrical insulator disposed between said commutator segment and the combustion chamber wall.

6. A centrally located ignition source in a combustion chamber, the combustion chamber having a rotary peripheral wall, the ignition source comprising:

an electrical delivery conductor having a base end adapted for mechanical connection to the combustion chamber, the delivery conductor extending into the combustion chamber and rotating therewith;

an electrical ground conductor having an electrically grounded end adapted for being mechanically and electrically connected to the rotary peripheral wall, the ground conductor extending into the combustion chamber and rotating therewith, the electrical delivery conductor and the electrical ground conductor defining an ignition spark gap therebetween, the electrical ground conductor being received within a recess formed in the rotary peripheral wall, the electrical ground conductor being selectively positionable with respect to the rotary peripheral wall to selectively adjust a width of the ignition spark gap;

an electrical commutator segment disposed within the rotary peripheral wall and subtending an arcuate portion thereof, the commutator segment communicating electrically with the electrical delivery conductor; and an electrical supply conductor communicating electrically with the commutator segment through a partial revolution of the rotary peripheral wall.

7. The centrally located ignition source according to claim 6, further including a contact brush extending from said electrical supply conductor, the brush periodically communicating electrically with said commutator segment in accordance with the rotation of the combustion chamber wall.

8. The centrally located ignition source according to claim 6, further including an electrical insulator disposed between said commutator segment and the combustion chamber wall.

9. The centrally located ignition source according to claim 6 wherein said electrical delivery conductor and said electrical ground conductor each comprise an elongate rod having adjacent electrode ends defining the ignition spark gap therebetween.

10. The centrally located ignition source according to claim 6, further including an electrical insulator tube disposed about said electrical delivery conductor and said electrical ground conductor.

11. The centrally located ignition source according to claim 10, wherein said electrical insulator tube has at least one spark exposure aperture disposed adjacent the ignition spark gap.

12. An opposed piston engine and a centrally located ignition source therefore, comprising in combination:

a cylinder block defining at least one centrally disposed cylinder bore having mutually opposed first and second ends;

a rotary sleeve valve disposed within the cylinder bore, the sleeve valve having a wall;

mutually opposed first and second pistons disposed within the sleeve valve;

a laterally symmetrical combustion chamber disposed between the first and second pistons, the chamber being defined by the first and second pistons and the sleeve valve;

an elongate electrical delivery conductor having a base end mechanically connected to a first side of the sleeve valve and an electrode end disposed within the sleeve valve opposite the base end, the electrical delivery conductor rotating with the sleeve valve;

an elongate electrical ground conductor having an electrically grounded end mechanically and electrically connected to a second side of the sleeve valve generally opposite the first side of the sleeve valve and an electrode end disposed within the sleeve valve opposite the electrically grounded end thereof, the ground conductor rotating with the sleeve valve, the electrode end of the electrical delivery conductor and of the electrical ground conductor defining an ignition spark gap therebetween, the electrically grounded end being received within a recess formed in the second side of the sleeve valve, the electrically grounded end being selectively positionable with respect to the sleeve valve to selectively adjust a width of the ignition spark gap; and an electrical supply conductor immovably affixed to and extending through the cylinder block to the cylinder bore and periodically communicating electrically with the base end of the electrical delivery conductor as the sleeve valve, the electrical delivery conductor, and the electrical ground conductor rotate in unison during engine operation.

13. The opposed piston engine and centrally located ignition source combination according to claim 12, further including an electrical commutator segment disposed within said rotary sleeve valve wall and subtending an arcuate portion thereof, said electrical supply conductor communicating electrically with said commutator segment through a partial revolution of said sleeve valve wall.

14. The opposed piston engine and centrally located ignition source combination according to claim 13, further including a contact brush extending from said electrical supply conductor, the brush periodically communicating electrically with said commutator segment in accordance with the rotation of said sleeve valve wall.

15. The opposed piston engine and centrally located ignition source combination according to claim 13, further including an electrical insulator disposed between said commutator segment and said sleeve valve wall.

16. The opposed piston engine and centrally located ignition source combination according to claim 12, further including an electrical insulator tube disposed about said electrical delivery conductor and said electrical ground conductor.

17. The opposed piston engine and centrally located ignition source combination according to claim 16, wherein said electrical insulator tube has at least one spark exposure aperture disposed adjacent the ignition spark gap.

* * * * *